US012635842B2

(12) United States Patent
Cheng et al.

(10) Patent No.: US 12,635,842 B2
(45) Date of Patent: May 26, 2026

(54) CLEANING ROBOT AND MOVEMENT CONTROL METHOD THEREOF

(71) Applicant: Dreame Innovation Technology (Suzhou) Co., Ltd., Suzhou (CN)

(72) Inventors: Tangdong Cheng, Suzhou (CN); Hongzhi Qian, Suzhou (CN); Yiming Zhu, Suzhou (CN); Yuanling Cheng, Suzhou (CN); Tianbao Dong, Suzhou (CN)

(73) Assignee: Dreame Innovation Technology (Suzhou) Co., Ltd., Suzhou (CN)

( * ) Notice: Subject to any disclaimer, the term of this patent is extended or adjusted under 35 U.S.C. 154(b) by 46 days.

(21) Appl. No.: 18/764,283

(22) Filed: Jul. 4, 2024

(65) Prior Publication Data

US 2025/0325160 A1 Oct. 23, 2025

(30) Foreign Application Priority Data

Apr. 18, 2024 (CN) ..... 202410467304.2

(51) Int. Cl.
*A47L 11/40* (2006.01)

(52) U.S. Cl.
CPC ..... *A47L 11/4061* (2013.01); *A47L 11/4011* (2013.01); *A47L 2201/04* (2013.01)

(58) Field of Classification Search
CPC ..... A47L 11/4061; A47L 11/4011; A47L 2201/04; G05D 2105/10; G05D 2109/10;
(Continued)

(56) References Cited

U.S. PATENT DOCUMENTS

2015/0002672 A1* 1/2015 Hayakawa ..... G08G 1/095 348/148
2017/0336796 A1* 11/2017 Jun ..... A47L 9/0472
(Continued)

FOREIGN PATENT DOCUMENTS

CN 106896814 A 6/2017
CN 107791232 A 3/2018
(Continued)

OTHER PUBLICATIONS

English translation of JP2022500763, obtained via Espacenet Feb. 5, 2026 (Year: 2026).*
(Continued)

*Primary Examiner* — Krishnan Ramesh
(74) *Attorney, Agent, or Firm* — Menachem Nathan; Nathan & Associates

(57) ABSTRACT

The present disclosure provides a cleaning robot and a movement control method thereof. Based on the method, during travel of the cleaning robot, three-dimensional information of an obstacle is acquired through a sensor system. When the obstacle moves within the detection range of the sensor system, when a distance between the obstacle and the cleaning robot along a central axis of the cleaning robot is less than a first preset detection threshold, and when a maximum value among included angles between connection lines constituted by a first reference point of the cleaning robot and second reference points of the obstacle and a current traveling direction of the cleaning robot is greater than a third preset detection threshold, an action away from the obstacle is intelligently performed.

11 Claims, 4 Drawing Sheets

(58) Field of Classification Search
CPC .. G05D 1/633; G05D 1/2435; G05D 2111/64; B25J 9/0003
USPC ..... 701/25
See application file for complete search history.

(56) References Cited

U.S. PATENT DOCUMENTS

| | | | | |
|---|---|---|---|---|
| 2019/0015982 | A1 | 1/2019 | Kou et al. | |
| 2020/0114517 | A1 | 4/2020 | Wang | |
| 2021/0316452 | A1 | 10/2021 | Ozaki et al. | |
| 2021/0330164 | A1* | 10/2021 | Ryu | G05D 1/0238 |
| 2023/0086937 | A1* | 3/2023 | Kuraoka | G06T 7/11 382/104 |
| 2023/0195130 | A1* | 6/2023 | Yin | G01S 17/931 701/23 |
| 2025/0093885 | A1* | 3/2025 | Suh | G05D 1/661 |

FOREIGN PATENT DOCUMENTS

| | | | | |
|---|---|---|---|---|
| CN | 111728534 | A | 10/2020 | |
| CN | 112155486 | A | 1/2021 | |
| CN | 112347876 | A | 2/2021 | |
| CN | 114434495 | A | 5/2022 | |
| CN | 114451814 | A | 5/2022 | |
| CN | 114594482 | A | 6/2022 | |
| CN | 115565058 | A | 1/2023 | |
| CN | 116540688 | A | 8/2023 | |
| CN | 116802583 | A | 9/2023 | |
| CN | 117462044 | A | 1/2024 | |
| CN | 118058658 | A | 8/2024 | |
| EA | 202491654 | A | 10/2025 | |
| EP | 4177639 | A1 | 5/2023 | |
| JP | 2010256276 | A | 11/2010 | |
| JP | 2013169221 | A | 9/2013 | |
| JP | 2020068897 | A | 5/2020 | |
| JP | 2020087074 | A | 6/2020 | |
| JP | 2021101808 | A | 7/2021 | |
| JP | 2022500763 | A * | 1/2022 | G06V 20/58 |
| KR | 20180085154 | A | 7/2018 | |
| WO | 2021120999 | A1 | 6/2021 | |
| WO | 2022252712 | A1 | 12/2022 | |

OTHER PUBLICATIONS

Annex to the European Search Report on European Patent Application No. EP24187692.9, dated Dec. 13, 2024.
Japanese Office Action issued in corresponding Japanese Patent Application No. 特願2024-095139 dated Aug. 12, 2025, pp. 1-4.
Australian Office Action issued in corresponding Australian Patent Application No. 2024204709 dated Aug. 13, 2025, pp. 1-5.
Examination report AU application 2024204709, dated Apr. 14, 2025.
Chinese First office action of Chinese application No. 202410467304.2 , mailed on May 8, 2024.
Chinese Notice of Allowance of Chinese application No. 202410467304.2 , mailed on May 22, 2024.
Korean Office Action issued in corresponding Korean Patent Application No. 10-2024-0075882 dated Jan. 19, 2026, pp. 1-5.
European Office Action issued in corresponding European Patent Application No. 24187692.9 dated Mar. 23, 2026, pp. 1-2.

* cited by examiner

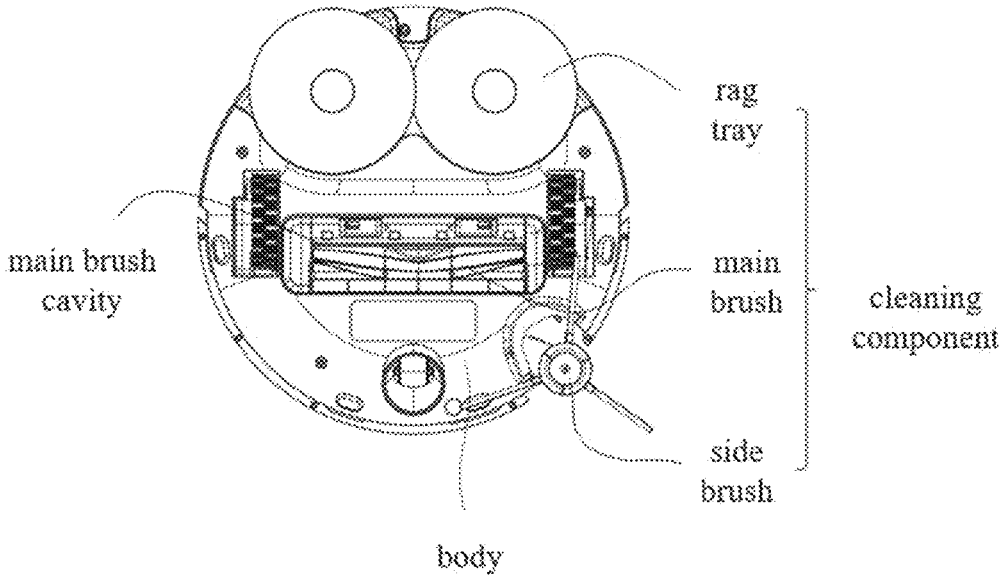

FIG. 1

During travel of the cleaning robot, when an obstacle moves within a detection range of the sensor system, when a distance between the obstacle and the cleaning robot along a central axis of the cleaning robot is less than a first preset detection threshold, when a maximum value among included angles between connection lines constituted by a first reference point of the cleaning robot and second reference points of the obstacle and a current traveling direction of the cleaning robot is greater than a third preset detection threshold, and when a minimum value among the included angles between the connection lines constituted by the first reference point of the cleaning robot and the second reference points of the obstacle and the current traveling direction of the cleaning robot is less than the third preset detection threshold, performing an action away from the obstacle to enable the sensor system to acquire three-dimensional information of the obstacle; where the central axis of the cleaning robot is parallel to the current traveling direction of the cleaning robot, the first reference point is one point closer to the obstacle along the current traveling direction in intersection points of a body boundary of the cleaning robot and the central axis of the cleaning robot, the second reference points are intersection points of an outer peripheral boundary of the obstacle and a reference line of the obstacle, and the reference line is perpendicular to the central axis S201

FIG. 2

CLEANING ROBOT AND MOVEMENT CONTROL METHOD THEREOF

CROSS-REFERENCE TO RELATED APPLICATION

This application claims priority to Chinese Patent Application No. 202410467304.2, filed on Apr. 18, 2024, the disclosure of which is incorporated herein by reference in its entirety.

TECHNICAL FIELD

The present disclosure relates to a technical field of smart home technologies, and in particular, to a cleaning robot and a movement control method of the cleaning robot.

BACKGROUND

With the development and popularization of technology, more and more users are becoming accustomed to using cleaning robots for indoor or outdoor cleaning operations.

Based on existing movement control methods of a cleaning robot, the cleaning robot needs to acquire and process obstacle information in real time during its movement. However, due to various reasons, sometimes the cleaning robot may not be able to effectively obtain the obstacle information, which in turn affects the movement and operation of the cleaning robot.

SUMMARY

The present disclosure provides a movement control method of a cleaning robot, and the movement control method is applied to the cleaning robot. The cleaning robot is equipped with a sensor system capable of acquiring three-dimensional information of an obstacle. The method includes: during travel of the cleaning robot, when the obstacle moves within a detection range of the sensor system, when a distance between the obstacle and the cleaning robot along a central axis of the cleaning robot is less than a first preset detection threshold, when a maximum value among included angles between connection lines constituted by a first reference point of the cleaning robot and second reference points of the obstacle and a current traveling direction of the cleaning robot is greater than a third preset detection threshold, and when a minimum value among the included angles between the connection lines constituted by the first reference point of the cleaning robot and the second reference points of the obstacle and the current traveling direction of the cleaning robot is less than the third preset detection threshold, performing an action away from the obstacle to enable the sensor system to acquire three-dimensional information of the obstacle; where the central axis of the cleaning robot is parallel to the current traveling direction of the cleaning robot, the first reference point is one point closer to the obstacle along the current traveling direction in intersection points of a body boundary of the cleaning robot and the central axis of the cleaning robot, the second reference points are intersection points of an outer peripheral boundary of the obstacle and a reference line of the obstacle, and the reference line is perpendicular to the central axis.

The present disclosure also provides a movement control method of a cleaning robot, the method is applied to the cleaning robot, the cleaning robot is provided with a sensor system capable of acquiring three-dimensional information of an obstacle, and the method includes: during travel of the cleaning robot, when the obstacle moves within a detection range of the sensor system, and when an observation angle of the cleaning robot relative to the obstacle is greater than a fourth preset detection threshold, performing an action away from the obstacle to enable the sensor system to acquire three-dimensional information of the obstacle.

The present disclosure also provides a movement control method of a cleaning robot, the method is applied to the cleaning robot, the cleaning robot is provided with a sensor system capable of acquiring three-dimensional information of an obstacle, and the method includes: during travel of the cleaning robot, when the obstacle moves within a detection range of the sensor system, when a distance between the obstacle and the cleaning robot along a central axis of the cleaning robot is less than a first preset detection threshold, when a maximum value among vertical distances between the obstacle and the central axis of the cleaning robot is greater than a second preset detection threshold, and when a minimum value among the vertical distances between the obstacle and the central axis of the cleaning robot is less than the second preset detection threshold, performing an action away from the obstacle to enable the sensor system to acquire three-dimensional information of the obstacle; where the central axis of the cleaning robot is parallel to the current traveling direction of the cleaning robot.

The present disclosure also provides a movement control method of a cleaning robot, the method is applied to the cleaning robot, the cleaning robot is provided with a sensor system capable of acquiring three-dimensional information of an obstacle, and the method includes: during travel of the cleaning robot, when the obstacle moves within a detection range of the sensor system, when a distance between the obstacle and the cleaning robot along a central axis of the cleaning robot is greater than or equal to a first preset detection threshold, when a maximum value among vertical distances between the obstacle and the central axis of the cleaning robot is greater than a second preset detection threshold, and when a minimum value among the vertical distances between the obstacle and the central axis of the cleaning robot is less than the second preset detection threshold, performing a steering action; where the central axis of the cleaning robot is parallel to the current traveling direction of the cleaning robot.

The present disclosure also provides a movement control method of a cleaning robot, the method is applied to the cleaning robot, the cleaning robot is provided with a sensor system capable of acquiring three-dimensional information of an obstacle, and the method includes: during travel of the cleaning robot, when the obstacle moves within a detection range of the sensor system, when a distance between the obstacle and the cleaning robot along a central axis of the cleaning robot is greater than or equal to a first preset detection threshold, when a maximum value among included angles between connection lines constituted by a first reference point of the cleaning robot and second reference points of the obstacle and a current traveling direction of the cleaning robot is greater than a third preset detection threshold, and when a minimum value among the included angles between the connection lines constituted by the first reference point of the cleaning robot and the second reference points of the obstacle and the current traveling direction of the cleaning robot is less than the third preset detection threshold, performing a steering action; where the central axis of the cleaning robot is parallel to the current traveling direction of the cleaning robot, the first reference point is one point closer to the obstacle along the current traveling direction in intersection points of a body boundary of the cleaning robot and the central axis of the cleaning robot, the second reference points are intersection points of an outer peripheral boundary of the obstacle and a reference line of the obstacle, and the reference line is perpendicular to the central axis.

The present disclosure also provides a cleaning robot, including a body a sensor system provided on the body and capable of acquiring three-dimensional information of an obstacle, a processor, and a memory for storing instructions executable by the processor.

During travel of the cleaning robot, when the processor executes the instructions, steps of the movement control method are implemented to enable the sensor system to acquire the three-dimensional information of the obstacle.

The present disclosure also provides a computer readable storage medium, which includes a stored program. The program is executed to perform the movement control method.

BRIEF DESCRIPTION OF THE DRAWINGS

FIG. 1 is a structural schematic diagram of a cleaning robot based on one or more embodiments of the present disclosure.

FIG. 2 is a schematic flowchart of a movement control method of a cleaning robot based on one or more embodiments of the present disclosure.

DETAILED DESCRIPTION

Figure 3:
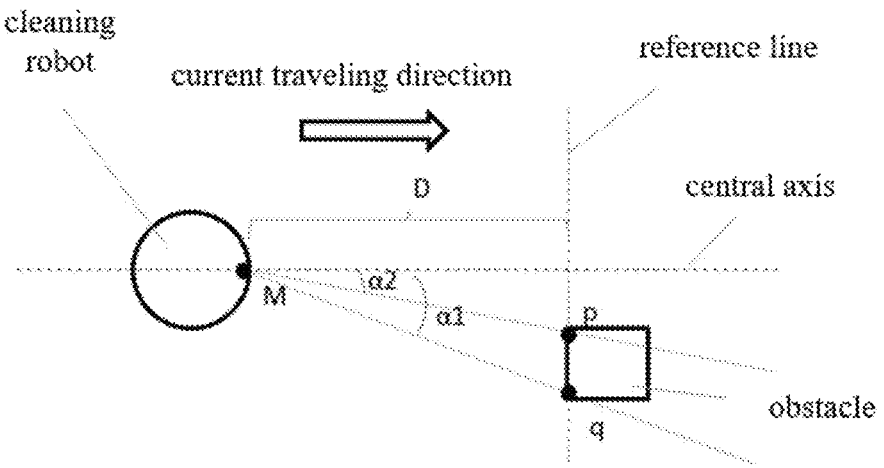
FIG. 3 schematically shows an example scenario where a movement control method of a cleaning robot based on one or more embodiments of the present disclosure can be applied.

Some embodiments of the present disclosure will be described in detail below with reference to the drawings. The embodiments are described for illustrative purposes only and are not intended to limit the present disclosure.

FIG. 1 illustrates a structure of a cleaning robot based on one or more embodiments of the present disclosure.

The above-mentioned cleaning robot may specifically be an autonomous robot that can move autonomously in an operation area and complete cleaning tasks autonomously without external human information input and control. The operation area may include indoor and outdoor areas. The indoor areas may include family rooms, offices, shopping malls, factory floors, etc. The outdoor areas may include lawns, gardens, paths, etc. The cleaning tasks may include cleaning (e.g., scrubbing, mopping, sweeping, etc.), lawn mowing, snow removal, etc.

The above-mentioned cleaning robot may be but not limited to a sweeping robot, a floor washing robot, a sweeping and mopping integrated robot, a lawn mowing robot, a snow clearing robot, or the like. The cleaning robot may clean by front sweeping and rear mopping or by sweeping and mopping separately. The way of front sweeping and rear mopping is to sweep and mop the floor at the same time, which may improve cleaning efficiency. The way of sweeping and mopping separately is to sweep the floor first and then mop the floor after sweeping, which may improve the cleaning effect.

Specifically, as illustrated in FIG. 1, the above-mentioned cleaning robot at least includes a body, a controller, one or more cleaning components, and a sensor system capable of acquiring three-dimensional information of an obstacle.

The above-mentioned cleaning components may specifically include one or more of the following listed: side brush, main brush (or roll brush), rag tray (or mop tray), etc.

Specifically, a shape of the above-mentioned body may be circular, square, or other shapes. For example, a part of the above-mentioned body may be circular and another part of the body may be square.

The above-mentioned controller may include a microcontroller unit (MCU). Of course, the above-mentioned controller may also include other elements capable of controlling functions.

A shape of the above-mentioned cleaning component may be circular, square, or other shapes (such as semicircle, arc, triangle, and other special shapes). The above-mentioned circular shape facilitates rotating cleaning of the cleaning component. The special shapes facilitate the cleaning component to clean corner areas.

The above-mentioned side brush may gather foreign objects and move the foreign objects toward a center of the bottom of the cleaning robot. The roller brush may sweep up the foreign objects at the bottom of the cleaning robot, thereby allowing the foreign objects to enter a dust collection box through a dust suction inlet. The rag tray is configured to wipe or mop the floor.

Specifically, the above-mentioned rag tray is provided with a rag. The cleaning robot is provided with a water tank. The water in the water tank flows through holes to the rag, moistening the rag. The wet rag is configured to mop the floor.

The above-mentioned main brush is arranged in the main brush cavity at the bottom of the body of the cleaning robot. The main brush cavity is communicated with a dust suction channel of the cleaning robot. Smaller garbage such as dust and hair swept up by the main brush and/or side brush are sucked in by the cleaning robot through the main brush cavity.

The above-mentioned sensor system is at least capable of acquiring the three-dimensional information of the obstacle, and the cleaning robot is capable of detecting and identifying the obstacle based on the three-dimensional information of the obstacle acquired by the sensor system. Furthermore, the controller is capable of controlling the cleaning robot accordingly based on the detected obstacle.

The above-mentioned sensor system may specifically include one or more of a monocular vision sensor, a binocular vision sensor, a line laser sensor, a surface laser sensor, a laser direct structuring (LDS) sensor, a direct time of flight (Dtof) sensor, an indirect time of flight (Itof) sensor, etc.

Specifically, the above-mentioned monocular vision sensor can acquire a projected image of an object on a two-dimensional plane through a single camera. The projected image may carry information such as a shape, size, color, and texture of the object. The above-mentioned binocular vision sensor can simulate human vision and acquire three-dimensional information of the object through two cameras.

The above-mentioned line laser sensor may be a sensor that uses line laser to achieve measurement. The above-mentioned surface laser sensor may be a sensor that uses surface laser to achieve measurement.

The above-mentioned LDS sensor may be an optical sensor that uses triangulation laser ranging. The above-mentioned Dtof sensor is also called a depth time flight sensor. The above-mentioned Dtof sensor can achieve depth information by sending an infrared laser pulse from a Dtof camera to measure the time it takes for the pulse to reach a target from the camera and return. The above-mentioned Itof sensor may specifically refer to a long-distance anti-interference Itof depth image sensor. The above Itof sensor transmits a modulated infrared light signal to a scenario, and then receives the light signal reflected back by a target to be measured in the scenario, and calculates a phase difference between the transmitted signal and the received signal according to the accumulated charge during the exposure (integration) time, so as to acquire the depth information of the target.

Of course, it should be noted that the sensors listed above are only schematic illustrations. During specific implementation, depending on specific circumstances and processing requirements, the above sensor system may also include other types of sensors such as infrared sensors.

Specifically, based on the above-mentioned sensor system, two-dimensional information (for example, plane images, etc.) and depth information of the obstacle within a certain range can be acquired; then, by fusing the above two-dimensional information and depth information of the obstacle, corresponding three-dimensional information of the obstacle is acquired; moreover, more accurate detection and identification of the obstacle may be achieved based on the three-dimensional information of the obstacle, and rich characteristic information of the obstacle such as shape, size, texture, etc. may be acquired.

Specifically, for example, an obstacle detection model pre-trained based on artificial intelligence algorithms may be used to intelligently detect and identify the obstacle by processing the three-dimensional information of the obstacle acquired by the sensor system, determine a specific type of the obstacle, and acquire the characteristic information of the obstacle such as shape, size, texture, etc.

Referring to FIG. 2, embodiments of the present disclosure provide a movement control method of a cleaning robot. The movement control method is applied to the cleaning robot. The cleaning robot is at least provided with a sensor system capable of acquiring three-dimensional information of an obstacle. The movement control method may include the following step S201 when implemented.

The step S201 includes: during travel of the cleaning robot, when an obstacle moves within a detection range of the sensor system, when a distance between the obstacle and the cleaning robot along a central axis of the cleaning robot is less than a first preset detection threshold, when a maximum value among included angles between connection lines constituted by a first reference point of the cleaning robot and second reference points of the obstacle and a current traveling direction of the cleaning robot is greater than a third preset detection threshold, and when a minimum value among the included angles between the connection lines constituted by the first reference point of the cleaning robot and the second reference points of the obstacle and the current traveling direction of the cleaning robot is less than the third preset detection threshold, performing an action away from the obstacle to enable the sensor system to acquire three-dimensional information of the obstacle; where the central axis of the cleaning robot is parallel to the current traveling direction of the cleaning robot, the first reference point is one point closer to the obstacle along the current traveling direction in intersection points of a body boundary of the cleaning robot and the central axis of the cleaning robot, the second reference points are intersection points of an outer peripheral boundary of the obstacle and a reference line of the obstacle, and the reference line is perpendicular to the central axis.

Specifically, the above-mentioned travel of the cleaning robot may be a process in which the cleaning robot cleans while moving, or may be a process in which the cleaning robot only moves but does not clean, etc.

Furthermore, the above-mentioned travel may specifically be a process traveling along a straight path, a process traveling along an arc path, or a process traveling along an irregular graphic path, etc.

Generally, when the cleaning robot is traveling, it detects whether there is an obstacle ahead through the sensor system in real time or regularly.

When an obstacle is detected, the cleaning robot acquires the three-dimensional information of the obstacle through the sensor system, and then detects and identifies the obstacle based on the three-dimensional information of the obstacle.

However, the above-mentioned sensor system has an effective detection range when operation. When a position of the obstacle relative to the cleaning robot is not within the effective detection range of the sensor system, the sensor system is often unable to effectively acquire the three-dimensional information of the obstacle that meets the requirements. For example, it is directly unable to acquire the three-dimensional information of the obstacle, or the quality of the acquired three-dimensional information is low and there is a lot of noise, which affects subsequent detection and identification of the obstacle.

Specifically, for example, when the cleaning robot is too close to the position of the obstacle, the position of the obstacle relative to the cleaning robot exceeds the effective detection range of the sensor system. At this time, some or even all sensors in the sensor system cannot effectively acquire signal data that meets the requirements. For example, because a distance to the obstacle is too close, the binocular vision sensor cannot focus normally and cannot acquire the image data that has high-quality, is clear, and contains the depth information, resulting in the sensor system being unable to effectively acquire the three-dimensional information of the obstacle.

For another example, when a size of the obstacle itself is too large (for example, a width of the obstacle is much larger than an ordinary object), the cleaning robot cannot acquire the three-dimensional information containing the complete obstacle based on its current position. At this time, it may also be understood that the position of the obstacle relative to the cleaning robot exceeds the effective detection range of the sensor system, resulting in the sensor system being unable to effectively acquire the three-dimensional information of the obstacle.

The present disclosure has paid attention to the above problems, and combined with specific reasons for the above problems, it is considered that a decision and judgment mechanism may be introduced to enable the cleaning robot to automatically judge and find situations in which during the travel the sensor system cannot effectively acquire the three-dimensional information of the obstacle that meet the requirements at present. Moreover, in the situations, the cleaning robot may be controlled in a timely and intelligent manner to perform a matching action, so that the sensor system can effectively acquire the three-dimensional information of the obstacle that meets the requirements.

In an embodiment, during travel, the cleaning robot detects a presence of the obstacle through the sensor system. Specifically, the cleaning robot detects whether there is an obstacle through a distance measuring sensor in the sensor system.

For example, the cleaning robot emits a line laser signal forward through a line laser sensor in the sensor system, acquires a returned line laser signal, and detects the presence of the obstacle based on the returned line laser signal.

The above obstacle specifically includes a sudden obstacle, such as a human, a pet, a rolling ball, a toy car, etc., which suddenly enters the operation area such as a living room and blocks a traveling path of the cleaning robot.

The detection range of the above-mentioned sensor system may specifically be understood as an upper limit range in which the sensor system can detect the presence of the obstacle. Specifically, when the position of the obstacle relative to the cleaning robot is within the detection range of the sensor system, the cleaning robot can detect the presence of the obstacle through the sensor system. However, it may not necessarily be able to effectively acquire the three-dimensional information of the obstacle that has higher quality and smaller error and meets the requirements.

During specific implementation, the cleaning robot can detect whether there is an obstacle within the detection range ahead through the sensor system at regular intervals or in real time, and compare a detection result at a current point in time with a detection result at an adjacent previous point in time to determine whether there is currently an obstacle moving within the detection range of the sensor system.

Specifically, for example, based on the detection result at the current time, when it is determined that there is an obstacle within the current detection range of the sensor system, the detection result at the adjacent previous point in time is queried and acquired. Based on the detection result at the adjacent previous point in time, it is determined whether the obstacle exists at the same or similar position area at the previous point in time. When it is determined that the obstacle does not exist in the same or similar position area at the previous point in time based on the detection result at the previous point in time, it is determined that an obstacle currently moves into the detection range of the sensor.

When it is detected that an obstacle moves within the detection range of the sensor system, it is further determined whether the position of the obstacle relative to the cleaning robot is within the effective detection range of the sensor system.

In an embodiment, referring to FIG. 3, the above-mentioned central axis of the cleaning robot may be understood as a central axis of a traveling plane of the cleaning robot along the current traveling direction. The above-mentioned central axis may be parallel to the current traveling direction of the cleaning robot.

Specifically, as illustrated in FIG. 3, a distance between the above-mentioned obstacle and the cleaning robot along the central axis of the cleaning robot may be understood as a projected length of a distance between the obstacle and the cleaning robot on the central axis, which is recorded as a first distance represented by D.

The above-mentioned first reference point may specifically be one point closer to the obstacle along the current traveling direction in intersection points of the body boundary of the cleaning robot and the central axis of the cleaning robot, and is represented by M.

The above-mentioned second reference points are intersection points of the outer peripheral boundary of the obstacle and the reference line of the obstacle, for example, a point p near the central axis and a point q away from the central axis, etc.

The above-mentioned reference line may specifically be understood as a line perpendicular to the central axis and spaced the first distance away from the current cleaning robot.

Correspondingly, referring to FIG. 3, the connection lines constituted by the first reference point of the cleaning robot and the second reference points of the obstacle may be specifically represented as a connection line Mp and a connection line Mq. The maximum value among the included angles between the connection lines constituted by the first reference point of the cleaning robot and the second reference points of the obstacle and the current traveling direction of the cleaning robot may be recorded as a first angle, represented by a1, that is, an included angle between the connection line Mq and the current traveling direction. The minimum value among the included angles between the connection lines constituted by the first reference point of the cleaning robot and the second reference points of the obstacle and the current traveling direction of the cleaning robot may be recorded as a second angle, represented by a2, that is, an included angle between the connection line Mp and the current traveling direction.

During specific implementation, first, the cleaning robot can measure and determine the first distance, the first angle, and the second angle through the sensor system.

Then, the cleaning robot can compare the detected first distance with the first preset detection threshold to acquire a corresponding first comparison result. Moreover, the detected first angle and the detected second angle are also respectively compared with the third preset detection threshold to acquire a corresponding third comparison result.

The above-mentioned third preset detection threshold may be specifically understood as an angle threshold used to prevent the cleaning robot from colliding with the obstacle. The above-mentioned third preset detection threshold may be specifically calculated based on size parameters of the body of the cleaning robot and the current distance between the obstacle and the cleaning robot along the central axis of the cleaning robot.

Then, the cleaning robot can determine whether the current position of the obstacle relative to the cleaning robot exceeds the effective detection range of the sensor system according to the first comparison result and the third comparison result.

During specific implementation, according to the first comparison result and the third comparison result, when it is determined that the first distance is less than the first preset detection threshold, the first angle is greater than the third preset detection threshold, and the second angle is less than the third preset detection threshold, it can be determined that the cleaning robot is currently too close to the obstacle, and the current position of the obstacle relative to the cleaning robot exceeds the effective detection range of the sensor system. If the cleaning robot continues to travel in the current traveling direction, it will collide with the obstacle. At this time, the cleaning robot needs to pay attention to the obstacle. Correspondingly, the cleaning robot is automatically controlled to perform a corresponding action away from the obstacle, so that the position of the obstacle relative to the cleaning robot is within the effective detection range of the sensor system.

Correspondingly, the cleaning robot is automatically controlled to perform the corresponding action away from the obstacle, so that the position of the obstacle relative to the cleaning robot is within the effective detection range of the sensor system, so that the three-dimensional information of the obstacle can be effectively acquired through the sensor system.

The above-mentioned action away from the obstacle may specifically include a backward action along a straight line, a backward action along a diagonal line, or a backward action along an arc, etc.

Specifically, for example, the cleaning robot may be controlled to perform a corresponding backward action to move away from the obstacle and increase the distance between the cleaning robot and the obstacle.

During a process of performing the backward action, the cleaning robot can also detect the first distance between the cleaning robot and the obstacle in real time or regularly through the sensor system. When it is detected that the first distance is greater than or equal to the first preset detection threshold, it can be determined that the position of the obstacle relative to the cleaning robot is within the effective detection range of the sensor system. At this time, the cleaning robot is controlled to stop the backward action and is tentatively located at the current position. Furthermore, the sensor system is also configured to re-detect the position area (which may be recorded as an obstacle area) where the obstacle was previously detected, and re-acquire relevant three-dimensional information of the obstacle, so that the obstacle can be specifically detected and identified based on the re-acquired three-dimensional information of the obstacle.

For another example, the cleaning robot may also be controlled to perform a steering action first, so that an orientation of the sensor system is as close or consistent as possible with a direction of the obstacle, and/or so that the cleaning robot is made to find the backward path without other obstacles as far as possible. Then, the cleaning robot performs a corresponding backward action away from the obstacle until the first distance between the cleaning robot and the obstacle is greater than or equal to the first preset detection threshold, and then the cleaning robot stops the backward action.

In this way, the three-dimensional information of the obstacle can be effectively acquired through the sensor system, and the type, shape and other characteristics of the obstacle can be accurately identified based on the three-dimensional information of the obstacle. Based on the above characteristics, the cleaning robot may adopt the most appropriate obstacle avoidance or cleaning strategy.

In a specific example scenario, as illustrated in FIG. 3, the body of the cleaning robot has a body diameter of 40 cm, the first preset detection threshold is 10 cm, and the third preset detection threshold is 65 degrees.

Specifically, during travel of the cleaning robot, when the obstacle suddenly moves within the detection range of the sensor system, the cleaning robot detects through the sensor system that the distance D between the obstacle and the cleaning robot along the central axis of the cleaning robot is 8 cm. Moreover, the cleaning robot also detects through the sensor system that the maximum value a1 of the included angles between the connection lines constituted by the first reference point of the cleaning robot and the second reference points of the obstacle and the current traveling direction of the cleaning robot is 71 degree and the minimum value a2 of the included angles between the connection lines constituted by the first reference point of the cleaning robot and the second reference points of the obstacle and the current traveling direction of the cleaning robot is 45 degrees. Then, through numerical comparison with the first preset detection threshold and the third preset detection threshold, it is determined that the distance D is less than the first preset detection threshold, a1 is greater than the third preset detection threshold, and a2 is less than the third preset detection threshold. Thus, it can be determined that the current position of the obstacle relative to the cleaning robot exceeds the effective detection range of the sensor system, and the cleaning robot can be triggered to automatically perform the action away from the obstacle.

During specific implementation, according to the first comparison result and the third comparison result, when it is determined that the first distance is less than the first preset detection threshold, and the first angle is less than the third preset detection threshold, it can be determined that the cleaning robot is currently too close to the obstacle, and the current position of the obstacle relative to the cleaning robot exceeds the effective detection range of the sensor system. If the cleaning robot continues to travel in the current traveling direction, it will collide with the obstacle. At this time, the cleaning robot needs to pay attention to the obstacle. Correspondingly, the cleaning robot can be controlled to perform the action away from the obstacle. In this way, the three-dimensional information of the obstacle can be effectively acquired through the sensor system, and the type, shape and other characteristics of the obstacle can be accurately identified based on the three-dimensional information of the obstacle. Based on the above characteristics, the cleaning robot may adopt the most appropriate obstacle avoidance or cleaning strategy.

During specific implementation, according to the first comparison result and the third comparison result, when it is determined that the first distance is less than the first preset detection threshold, and the second angle is greater than the third preset detection threshold, it can be determined that the cleaning robot is currently too close to the obstacle, the current position of the obstacle relative to the cleaning robot exceeds the effective detection range of the sensor system, and the obstacle is far away from the central axis of the cleaning robot, so that the cleaning robot will not collide with the obstacle even if it continues to travel in the current direction. At this time, the cleaning robot does not need to pay attention to the obstacle, and the cleaning robot does not need to perform the action away from the obstacle. Specifically, for example, the cleaning robot can be controlled to continue traveling and working, while continuing to acquire the three-dimensional information of the obstacle ahead through the sensor system. In this way, there is no need to waste resources to perform an unnecessary action away from the obstacle, and avoid affecting the normal movement, cleaning and other work of the cleaning robot. At the same time, it also reduces the data processing burden during the operation of the cleaning robot.

During specific implementation, according to the first comparison result and the third comparison result, when it is determined that the first distance is greater than or equal to the first preset detection threshold, it can be determined that the current position of the obstacle relative to the cleaning robot is within the effective detection range of the sensor system, or it can be determined that the obstacle is currently too far away from the cleaning robot and does not affect the traveling progress and operation of the cleaning robot. Thus, there is no need to pay attention to the obstacle for the time being. At this time, the cleaning robot does not need to perform the action away from the obstacle. In this way, there is no need to waste resources to perform the unnecessary action away from the obstacle, and avoid affecting the normal movement, cleaning and other work of the cleaning robot. At the same time, it also reduces the data processing burden during the operation of the cleaning robot.

In an embodiment, the sensor system may specifically include one or more of a monocular vision sensor, a binocular vision sensor, a line laser sensor, a surface laser sensor, a LDS sensor, a Dtof sensor, an Itof sensor, etc. The first preset detection threshold is a minimum value among effective detection distances of the sensors in the sensor system.

During specific implementation, a minimum value among effective detection distances of each sensor in the sensor system may be determined respectively. Then, the smallest value is further determined from the plurality of minimum values of the effective detection distances as the first preset detection threshold.

Based on the above embodiments, by determining and using the above-mentioned first preset detection threshold as a relevant threshold for detection and judgment, it may more accurately determine whether the current position of the obstacle relative to the cleaning robot exceeds the effective detection range of the sensor system.

In an embodiment, the movement control method is implemented by further including a step of:

When the distance between the obstacle and the cleaning robot along the central axis of the cleaning robot is less than the first preset detection threshold, and when the minimum value among the included angles between the connection lines constituted by the first reference point of the cleaning robot and the second reference points of the obstacle and the current traveling direction of the cleaning robot is greater than or equal to the third preset detection threshold, not performing the action away from the obstacle and continuing to travel along a current traveling path.

This eliminates the need to waste processing resources and processing time by performing the unnecessary action away from the obstacle, avoid affecting the normal movement and cleaning of the cleaning robot, save the moving time of the cleaning robot, and improve the cleaning efficiency of the cleaning robot. At the same time, it may also reduce the data processing burden during the operation of the cleaning robot.

In an embodiment, the cleaning robot performs the action away from the obstacle until it moves to a first position, and a distance between the first position and the obstacle is less than a maximum value among the effective detection distances of the sensors in the sensor system.

Based on the above embodiment, excessive backward action of the cleaning robot may be avoided, resulting in the inability to acquire the three-dimensional information of the obstacle precisely due to being too far away from the obstacle. At the same time, it may also effectively reduce the waste of energy on the excessive backward action of the cleaning robot.

In an embodiment, after performing the action away from the obstacle, the movement control method is implemented by further including a step of: performing a steering action to adjust a detection direction of the sensor system so that the sensor system acquires the three-dimensional information of the obstacle.

During specific implementation, the current detection direction of the sensor system and a current direction of the obstacle relative to the cleaning robot are determined first; then a direction deviation angle between the sensor system and the obstacle is determined based on the current detection direction of the sensor system and the current direction of the obstacle relative to the cleaning robot; and then the cleaning robot is controlled to perform the steering action according to the direction deviation angle, so that the sensor system may be as facing as possible against the obstacle. This allows the sensor system to more effectively and accurately acquire the three-dimensional information of the obstacle that meets the requirements.

During specific implementation, the cleaning robot may also acquire three-dimensional information of an obstacle behind it, then re-plan and determine the backward path without the obstacle based on the three-dimensional information of the rear obstacle, then perform the corresponding steering action to make a posture of the cleaning robot match the backward path, and then be controlled to perform the backward action along the backward path. This may effectively prevent the cleaning robot from colliding with the rear obstacle during the backward action.

Figure 4:
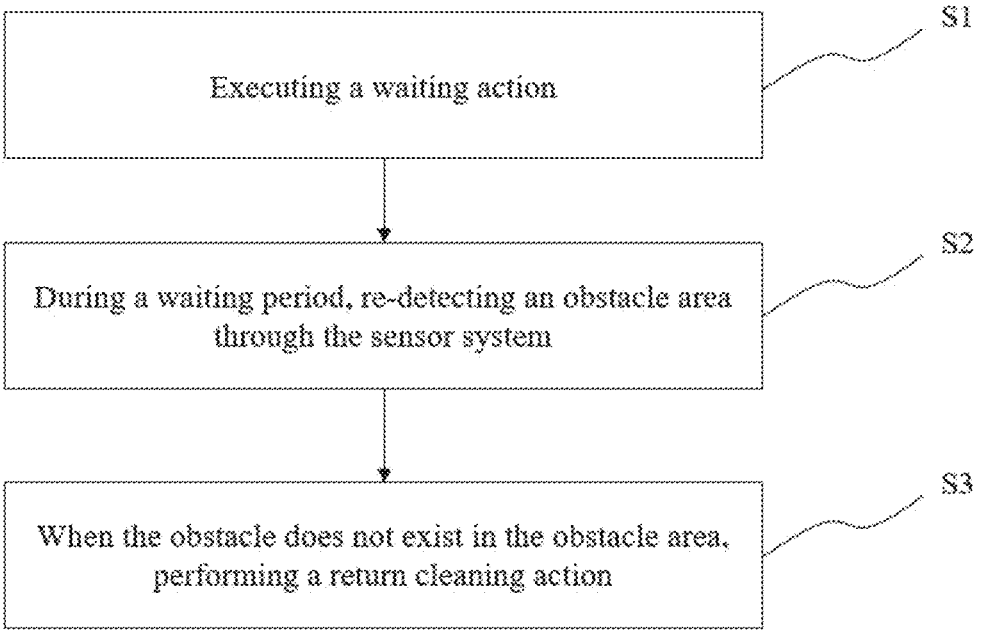
FIG. 4 is a schematic flowchart of a movement control method of a cleaning robot based on one or more embodiments of the present disclosure.

In an embodiment, after performing the action away from the obstacle, as illustrated in FIG. 4, the movement control method is implemented by further including steps of S1, S2, and S3.

The step S1 includes: executing a waiting action.

The step S2 includes: during a waiting period, re-detecting an obstacle area through the sensor system.

The step S3 includes: when the obstacle does not exist in the obstacle area, performing a return cleaning action.

After re-detecting the obstacle area through the sensor system, the movement control method is implemented by further including a step of: when the obstacle exists in the obstacle area, re-planning a cleaning path and performing a detour action.

Specifically, when the cleaning robot is performing the action away from the obstacle, and when the first distance between the cleaning robot and the obstacle is greater than or equal to the first preset detection threshold, the cleaning robot stops the action away from the obstacle and is tentatively located at the current position to perform the waiting action. During the waiting period, the cleaning robot re-detects the obstacle area where the obstacle is previously detected through the sensor system to determine whether the obstacle still exists in the obstacle area.

The above-mentioned obstacle area may specifically be understood as a position area where the obstacle is detected before the action of moving away from the obstacle is performed.

Specifically, for example, the above-mentioned obstacle area may be re-detected through a distance measuring sensor in the sensor system to determine whether the obstacle still exists in the obstacle area.

When it is determined that the obstacle no longer exists in the obstacle area, the cleaning robot re-plans the cleaning path, and then the cleaning robot performs the return cleaning action to return to the obstacle area for supplementary cleaning according to the cleaning path.

When it is determined that the obstacle still exists in the obstacle area, the cleaning robot can re-acquire the three-dimensional information of the obstacle through the sensor system, and detect and identify the obstacle based on the three-dimensional information of the obstacle to determine the specific type of the obstacle. Furthermore, the cleaning path that matches the obstacle may be re-planned based on the specific type of the obstacle, and then the detour action is performed based on the cleaning path. In this way, the cleaning robot may clean as many areas as possible while avoiding obstacles, and obtain better cleaning results.

In an embodiment, after re-detected by the sensor system, the movement control method is implemented by further including a step of: when the obstacle exists in the obstacle area and the obstacle is a human, broadcasting relevant prompt information by voice.

Specifically, after re-detected by the sensor system, when it is determined that the obstacle still exists in the obstacle area, the three-dimensional information of the obstacle with higher quality and smaller error may be effectively acquired through the sensor system as the three-dimensional information of the obstacle that meets the requirements.

Then, a pre-trained obstacle detection model may be used to process the above three-dimensional information of the obstacle to acquire corresponding obstacle detection results. The above-mentioned obstacle detection model may be specifically understood as a neural network model which is trained in advance using a large amount of three-dimensional information of sample obstacles and can automatically identify and determine the obstacle type.

According to the above obstacle detection results, when it is determined that the obstacle is a human, relevant prompt information may be broadcast by voice to the human. For example, a voice prompts the human to move out of the way to facilitate cleaning.

After the relevant prompt information is broadcast by voice, the obstacle area is re-detected through the sensor system after a preset time interval (for example, an interval of 1 minute). When the obstacle does not exist in the obstacle area, the return cleaning action is performed.

It can be seen from the above that, in the movement control method of the cleaning robot provided by the embodiments of the present disclosure, during travel of the cleaning robot, the three-dimensional information of the obstacle can be acquired through the sensor system. When an obstacle moves within the detection range of the sensor system, when the distance between the obstacle and the cleaning robot along the central axis of the cleaning robot is less than the first preset detection threshold, when the maximum value among the included angles between the connection lines constituted by the first reference point of the cleaning robot and the second reference points of the obstacle and the current traveling direction of the cleaning robot is greater than the third preset detection threshold, and when the minimum value among the included angles between the connection lines constituted by the first reference point of the cleaning robot and the second reference points of the obstacle and the current traveling direction of the cleaning robot is less than the third preset detection threshold, it can be automatically determined that the sensor system cannot effectively obtain the three-dimensional information of the obstacle with high quality and meeting the requirements at present, and then the action away from the obstacle is intelligently performed. This allows the sensor system of the cleaning robot to effectively acquire the three-dimensional information of the obstacle that meets the requirements and achieve accurate identification of the obstacle. In turn, the cleaning robot may adopt the most appropriate obstacle avoidance or cleaning strategy based on the above obstacle identification results.

Figure 5:
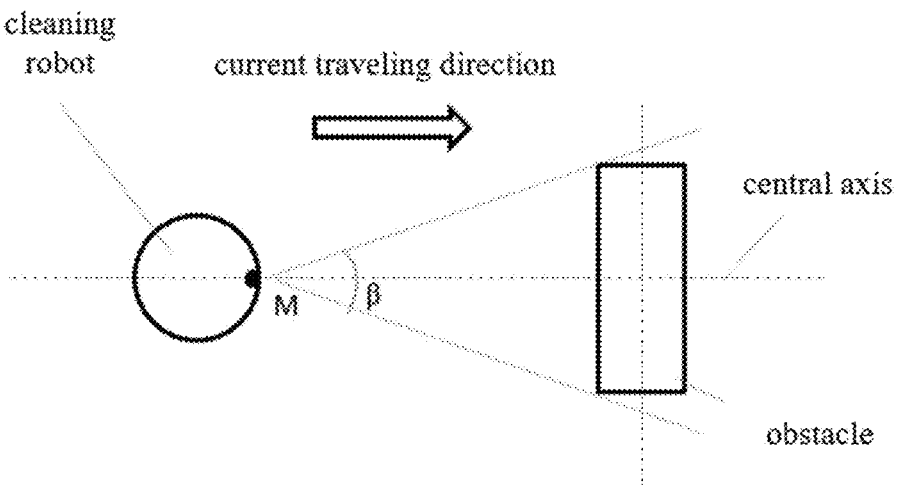
FIG. 5 schematically shows another example scenario where a movement control method of a cleaning robot based on one or more embodiments of the present disclosure can be applied.

Referring to FIG. 5, the present disclosure also provides another movement control method of a cleaning robot, which is applied to the cleaning robot. The cleaning robot is equipped with a sensor system capable of acquiring three-dimensional information of an obstacle. A specific implementation of the movement control method may include a step of:

During travel of the cleaning robot, when an obstacle moves within a detection range of the sensor system, and when an observation angle of the cleaning robot relative to the obstacle is greater than a fourth preset detection threshold, performing an action away from the obstacle to enable the sensor system to acquire three-dimensional information of the obstacle.

Subsequently, a type, shape, size and other characteristics of the obstacle may be accurately identified based on the above three-dimensional information of the obstacle, and obstacle identification results with higher accuracy and better effect can be obtained. Based on the obstacle identification results, the cleaning robot may adopt the most appropriate obstacle avoidance or cleaning strategy.

In an embodiment, as illustrated in FIG. 5, the above-mentioned observation angle of the cleaning robot relative to the obstacle may be specifically understood as an included angle formed by tangent lines of the outer peripheral boundary of the obstacle passing through the first reference point of the cleaning robot, which is represented by $\beta$.

The above-mentioned fourth preset detection threshold may be specifically understood as a maximum value among field angles of the sensor system. Specifically, the above-mentioned field angle may be an included angle formed between two edges of a maximum range of a lens that an object image of a measured target can pass through when taking the lens in the sensor system as a vertex. This included angle determines a field view range of the sensor system. Generally, the larger the field angle, the wider the field view range.

Specifically, the above-mentioned fourth preset detection threshold may be determined based on performance parameters such as the field view ranges of the sensors in the sensor system.

During specific implementation, first, the cleaning robot measures and determines the observation angle of the cleaning robot relative to the obstacle through the sensor system.

Then, the cleaning robot compares the detected observation angle with the fourth preset detection threshold to acquire a corresponding fourth comparison result.

Then, according to the fourth comparison result, when it is determined that the observation angle of the cleaning robot relative to the obstacle is greater than the fourth preset detection threshold, it can be determined that the cleaning robot is currently too close to the obstacle, and/or it can be determined that a size of the obstacle is too large, resulting in the sensor system currently being unable to acquire complete three-dimensional information of the obstacle. That is, the current position of the obstacle relative to the cleaning robot exceeds the effective detection range of the sensor system. At this time, the cleaning robot performs the action away from the obstacle, so that the sensor system can effectively acquire the three-dimensional information of the obstacle that meets the requirements. Subsequently, the type, shape, size and other characteristics of the obstacle can be accurately identified based on the above three-dimensional information of the obstacle, and obstacle identification results with higher accuracy and better effect can be obtained. Based on the obstacle identification results, the cleaning robot may adopt the most appropriate obstacle avoidance or cleaning strategy.

During specific implementation, according to the fourth comparison result, when it is determined that the observation angle of the cleaning robot relative to the obstacle is less than the fourth preset detection threshold, it can be determined that the sensor system can acquire complete three-dimensional information of the obstacle. That is, the current position of the obstacle relative to the cleaning robot is within the effective detection range of the sensor system. At this time, the cleaning robot does not need to perform the action of moving away from the obstacle, thereby preventing the cleaning robot from performing the unnecessary action of moving away from the obstacle, which saves the moving time of the cleaning robot and improves the cleaning efficiency of the cleaning robot.

In an embodiment, on a condition that the observation angle includes a vertical observation angle, the fourth preset detection threshold includes a vertical field angle threshold of the sensor system.

The above-mentioned vertical observation angle may be specifically understood as an observation angle along a vertical direction. The above-mentioned vertical field angle threshold may be specifically understood as a field angle threshold along the vertical direction.

Correspondingly, during specific implementation, when the vertical observation angle of the cleaning robot relative to the obstacle is greater than the corresponding vertical field angle threshold, the action away from the obstacle is performed, so that the sensor system can effectively acquire the three-dimensional information of the obstacle that meets the requirements.

On the contrary, when the vertical observation angle of the cleaning robot relative to the obstacle is less than the corresponding vertical field angle threshold, it is not necessary to perform the action away from the obstacle, which saves the moving time of the cleaning robot and improves the cleaning efficiency of the cleaning robot.

In an embodiment, on a condition that the observation angle includes a horizontal observation angle, the fourth preset detection threshold includes a horizontal field angle threshold of the sensor system.

The above-mentioned horizontal observation angle may be specifically understood as an observation angle along a horizontal direction, and the above-mentioned horizontal field angle threshold may be specifically understood as a field angle threshold along the horizontal direction.

Correspondingly, during specific implementation, when the horizontal observation angle of the cleaning robot relative to the obstacle is greater than the corresponding horizontal field angle threshold, the action away from the obstacle is performed, so that the sensor system can effectively acquire the three-dimensional information of the obstacle that meets the requirements. Subsequently, the type, shape, size and other characteristics of the obstacle can be accurately identified based on the above three-dimensional information of the obstacle, and obstacle identification results with higher accuracy and better effect can be obtained. Based on the obstacle identification results, the cleaning robot may adopt the most appropriate obstacle avoidance or cleaning strategy.

On the contrary, when the horizontal observation angle of the cleaning robot relative to the obstacle is less than the corresponding horizontal field angle threshold, it is not necessary to perform the action away from the obstacle, which saves the moving time of the cleaning robot and improves the cleaning efficiency of the cleaning robot.

In an embodiment, on a condition that the observation angle includes a horizontal observation angle and a vertical observation angle, the fourth preset detection threshold includes a horizontal field angle threshold and a vertical field angle threshold of the sensor system.

Correspondingly, during specific implementation, when the vertical observation angle of the cleaning robot relative to the obstacle is greater than the corresponding vertical field angle threshold, and when the horizontal observation angle is greater than the corresponding horizontal field angle threshold, the action of moving away from the obstacle is performed, so that the sensor system can effectively acquire the three-dimensional information of the obstacle that meets the requirements. Subsequently, the type, shape, size and other characteristics of the obstacle can be accurately identified based on the above three-dimensional information of the obstacle, and obstacle identification results with higher accuracy and better effect can be obtained. Based on the obstacle identification results, the cleaning robot may adopt the most appropriate obstacle avoidance or cleaning strategy.

On the contrary, when the vertical observation angle of the cleaning robot relative to the obstacle is less than the corresponding vertical field angle threshold, and/or when the horizontal observation angle is less than the corresponding horizontal field angle threshold, it is not necessary to perform the action away from the obstacle, which saves the moving time of the cleaning robot and improves the cleaning efficiency of the cleaning robot.

In an embodiment, the sensor system includes one or more of a monocular vision sensor, a binocular vision sensor, a line laser sensor, a surface laser sensor, a LDS sensor, a Dtof sensor, an Itof sensor, etc.

In an embodiment, the cleaning robot performs the action away from the obstacle until it moves to a first position. A distance between the first position and the obstacle is less than a maximum value among effective detection distances of the sensors in the sensor system.

In an embodiment, after performing the action away from the obstacle, the movement control method further includes a step of: performing a steering action to adjust a detection direction of the sensor system so that the sensor system acquires the three-dimensional information of the obstacle.

In an embodiment, after performing the action away from the obstacle, the movement control method further includes steps of: executing a waiting action; during a waiting period, re-detecting an obstacle area through the sensor system; and when the obstacle does not exist in the obstacle area, performing a return cleaning action.

In an embodiment, after re-detected by the sensor system, the movement control method further includes a step of: when the obstacle exists in the obstacle area, re-planning a cleaning path and performing a detour action.

In an embodiment, after re-detected by the sensor system, the movement control method further includes a step of: when the obstacle exists in the obstacle area and the obstacle is a human, broadcasting relevant prompt information by voice.

It can be seen from the above that, in the movement control method of the cleaning robot provided by the embodiments of the present disclosure, during travel of the cleaning robot, the three-dimensional information of the obstacle is acquired through the sensor system. When an obstacle moves within the detection range of the sensor system, and when the observation angle of the cleaning robot relative to the obstacle is greater than the fourth preset detection threshold, it can be automatically determined that the sensor system cannot effectively obtain the three-dimensional information of the obstacle with high quality and meeting the requirements at present, and then the action away from the obstacle is intelligently performed. This allows the sensor system of the cleaning robot to effectively acquire the three-dimensional information of the obstacle that meets the requirements and achieve accurate identification of the obstacle. Specifically, the type, shape, size and other characteristics of the obstacle can be accurately identified based on the above three-dimensional information of the obstacle, and obstacle identification results with higher accuracy and better effect can be obtained. Based on the obstacle identification results, the cleaning robot may adopt the most appropriate obstacle avoidance or cleaning strategy.

Figure 6:
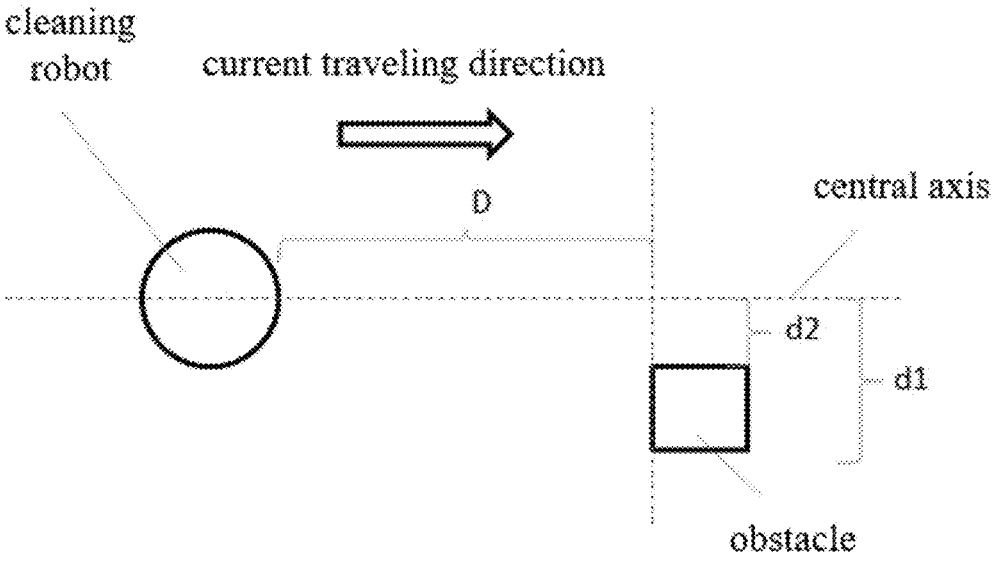
FIG. 6 schematically shows another example scenario where a movement control method of a cleaning robot based on one or more embodiments of the present disclosure can be applied.

Referring to FIG. 6, the present disclosure also provides another movement control method of a cleaning robot, which is applied to the cleaning robot. The cleaning robot is equipped with a sensor system capable of acquiring three-dimensional information of the obstacle. The specific implementation of the movement control method may include a step of:

During travel of the cleaning robot, when an obstacle moves within a detection range of the sensor system, when a distance between the obstacle and the cleaning robot along a central axis of the cleaning robot is less than a first preset detection threshold, when a maximum value among vertical distances between the obstacle and the central axis of the cleaning robot is greater than a second preset detection threshold, and when a minimum value among the vertical distances between the obstacle and the central axis of the cleaning robot is less than the second preset detection threshold, performing an action away from the obstacle to enable the sensor system to acquire three-dimensional information of the obstacle; where the central axis of the cleaning robot is parallel to the current traveling direction of the cleaning robot.

In an embodiment, referring to FIG. 6, the above-mentioned central axis of the cleaning robot may be understood as a central axis of a traveling plane of the cleaning robot along the current traveling direction. The above-mentioned central axis may be parallel to the current traveling direction of the cleaning robot.

Specifically, as illustrated in FIG. 6, the distance between the above-mentioned obstacle and the cleaning robot along the central axis of the cleaning robot may be understood as a projected length of a distance between the obstacle and the cleaning robot on the central axis, which is recorded as a first distance represented by D.

The vertical distance between the above-mentioned obstacle and the central axis of the cleaning robot may be specifically understood as a perpendicular length of one point on the outer peripheral boundary of the obstacle relative to the central axis, which is recorded as a second distance represented by d.

It should be noted that the second distance determined based on different points on the outer peripheral boundary of the obstacle may be different values. The maximum value among the second distances, that is, the maximum value among the vertical distances between the obstacle and the central axis of the cleaning robot, is represented by d1. The minimum value among the second distances, that is, the minimum value among the vertical distances between the obstacle and the central axis of the cleaning robot, is represented by d2.

In an embodiment, as illustrated in FIG. 6, when the obstacle moves within the detection range of the sensor system, the cleaning robot measures and determines the distance (the first distance, abbreviated as D) between the obstacle and the cleaning robot along the central axis of the cleaning robot, the maximum value among the vertical distances (the maximum value among the second distances, abbreviated as d1) between the obstacle and the central axis of the cleaning robot, and the minimum value among the vertical distances (the minimum value among the second distances, abbreviated as d2) between the obstacle and the central axis of the cleaning robot through the sensor system (for example, a distance measuring sensor in the sensor system).

During specific implementation, for example, first, the cleaning robot can acquire the corresponding first distance, the maximum value among the second distances, and the minimum value among the second distances by using a line laser sensor in the sensor system alone.

Then, the cleaning robot can compare the detected first distance with the first preset detection threshold to acquire a corresponding first comparison result. Moreover, the detected maximum value among the second distances and the detected minimum value among the second distances are also compared with the second preset detection threshold respectively to acquire a corresponding second comparison result.

The above-mentioned first preset detection threshold may be specifically understood as a minimum value among the effective detection distances of the sensor system. Generally, when the first distance between the cleaning robot and the obstacle is less than the first preset detection threshold, the sensor system as a whole cannot effectively acquire the three-dimensional information of the obstacle due to reasons such as failure to focus.

The above-mentioned second preset detection threshold may be specifically understood as a threshold distance perpendicular to the central axis used to prevent the cleaning robot from colliding with the obstacle. The second preset detection threshold may be specifically determined based on size parameters of the body of the cleaning robot.

Then, the cleaning robot can determine whether the current position of the obstacle relative to the cleaning robot exceeds the effective detection range of the sensor system based on the first comparison result and the second comparison result.

During specific implementation, according to the first comparison result and the second comparison result, when it is determined that the first distance is less than the first preset detection threshold, when the maximum value among the second distances is greater than the second preset detection threshold, and when the minimum value among the second distances is less than the second preset detection threshold, it can be determined that the cleaning robot is currently too close to the obstacle, and the current position of the obstacle relative to the cleaning robot exceeds the effective detection range of the sensor system. If the cleaning robot continues to travel in the current traveling direction, it will also collide with the obstacle. At this time, the cleaning robot needs to pay attention to the obstacle.

Correspondingly, the cleaning robot can be automatically controlled to perform the corresponding action away from the obstacle, so that the position of the obstacle relative to the cleaning robot is within the effective detection range of the sensor system, so that the three-dimensional information of the obstacle can be effectively acquired through the sensor system.

The above-mentioned action away from the obstacle may specifically include a backward action along a straight line, a backward action along a diagonal line, or a backward action along an arc, etc.

Specifically, for example, the cleaning robot may be controlled to perform a corresponding backward action to move away from the obstacle and increase the distance between the cleaning robot and the obstacle.

During a process of performing the backward action, the cleaning robot can also detect the first distance between the cleaning robot and the obstacle in real time or regularly through the sensor system. When it is detected that the first distance is greater than or equal to the first preset detection threshold, it can be determined that the position of the obstacle relative to the cleaning robot is within the effective detection range of the sensor system. At this time, the cleaning robot is controlled to stop the backward action and is tentatively located at the current position. Furthermore, the sensor system is also configured to re-detect the position area (which may be recorded as the obstacle area) where the obstacle was previously detected, and re-acquire relevant three-dimensional information of the obstacle, so that the obstacle can be specifically detected and identified based on the re-acquired three-dimensional obstacle information.

For another example, the cleaning robot may also be controlled to perform a steering action first, so that an orientation of the sensor system is as close or consistent as possible with a direction of the obstacle, and/or so that the cleaning robot is made to find the backward path without other obstacles as far as possible. Then, the cleaning robot performs a corresponding backward action away from the obstacle until the first distance between the cleaning robot and the obstacle is greater than or equal to the first preset detection threshold, and then the cleaning robot stops the backward action.

During specific implementation, according to the first comparison result and the second comparison result, when it is determined that the first distance is less than the first preset detection threshold, and when the maximum value among the second distances is less than or equal to the second preset detection threshold, it can be determined that the cleaning robot is currently too close to the obstacle, and the current position of the obstacle relative to the cleaning robot exceeds the effective detection range of the sensor system. If the cleaning robot continues to travel in the current traveling direction, it will collide with the obstacle. At this time, the cleaning robot needs to pay attention to the obstacle. Correspondingly, the cleaning robot can be controlled to perform the action away from the obstacle.

During specific implementation, according to the first comparison result and the second comparison result, when it is determined that the first distance is less than the first preset detection threshold, and when the minimum value among the second distances is greater than the second preset detection threshold, it can be determined that the cleaning robot is currently too close to the obstacle, and the current position of the obstacle relative to the cleaning robot exceeds the effective detection range of the sensor system. If the cleaning robot continues to travel in the current traveling direction, it will not collide with the obstacle. At this time, the cleaning robot does not need to pay attention to the obstacle, and the cleaning robot does not need to perform the action away from the obstacle. Specifically, for example, the cleaning robot can be controlled to continue traveling and working (for example, cleaning), while continuing to acquire the three-dimensional information of the obstacle ahead through the sensor system.

During specific implementation, according to the first comparison result and the second comparison result, when it is determined that the first distance is greater than or equal to the first preset detection threshold, it can be determined that the current position of the obstacle relative to the cleaning robot is within the effective detection range of the sensor system, or it can be determined that the obstacle is currently too far away from the cleaning robot and does not affect the traveling progress and operation of the cleaning robot. Thus, there is no need to pay attention to the obstacle for the time being. At this time, the cleaning robot does not need to perform the action away from the obstacle.

In an embodiment, a specific value of the second preset detection threshold may be greater than or equal to 0.45 times a maximum length of the body of the cleaning robot in a direction perpendicular to the central axis of the cleaning robot, and less than or equal to 0.55 times the maximum length of the body of the cleaning robot in the direction perpendicular to the central axis of the cleaning robot.

Specifically, for example, the specific value of the second preset detection threshold may be 0.51 times or 0.53 times the maximum length of the body of the cleaning robot in the direction perpendicular to the central axis of the cleaning robot. For another example, the above-mentioned second preset detection threshold may specifically be 180 mm or 200 mm.

Based on the above embodiments, by determining and using the above-mentioned second preset detection threshold as the relevant threshold for detection and judgment, it may more accurately determine whether the cleaning robot collides with the obstacle during travel.

In an embodiment, the sensor system may specifically include one or more of a monocular vision sensor, a binocular vision sensor, a line laser sensor, a surface laser sensor, a LDS sensor, a Dtof sensor, an Itof sensor, etc. The first preset detection threshold is a minimum value among effective detection distances of the sensors in the sensor system.

During specific implementation, a minimum value among effective detection distances of each sensor in the sensor system may be determined respectively. Then, the smallest value is further determined from the plurality of minimum values of the effective detection distances as the first preset detection threshold.

Based on the above embodiments, by determining and using the above-mentioned first preset detection threshold as the relevant threshold for detection and judgment, it may more accurately determine whether the current position of the obstacle relative to the cleaning robot exceeds the effective detection range of the sensor system.

In an embodiment, the cleaning robot performs the action away from the obstacle until it moves to a first position, and a distance between the first position and the obstacle is less than a maximum value among the effective detection distances of the sensors in the sensor system.

In an embodiment, after performing the action away from the obstacle, the movement control method is implemented by further including a step of: performing a steering action to adjust a detection direction of the sensor system so that the sensor system acquires the three-dimensional information of the obstacle.

During specific implementation, the current detection direction of the sensor system and a current direction of the obstacle relative to the cleaning robot are determined first; then a direction deviation angle between the sensor system and the obstacle is determined based on the current detection direction of the sensor system and the current direction of the obstacle relative to the cleaning robot; and then the cleaning robot is controlled to perform the steering action according to the direction deviation angle, so that the sensor system may be as facing as possible against the obstacle. This allows the sensor system to more effectively and accurately acquire the three-dimensional information of the obstacle that meets the requirements.

During specific implementation, three-dimensional information of a rear obstacle may also be acquired, then a backward path without the obstacle is re-planed and determined based on the three-dimensional information of the rear obstacle, then the corresponding steering action is performed to match the backward path, and then the backward action along the backward path is performed. This may effectively prevent the cleaning robot from colliding with the rear obstacle during the backward action.

In an embodiment, after performing the action away from the obstacle, the movement control method is implemented by further including steps of: executing a waiting action; during a waiting period, re-detecting an obstacle area through the sensor system; and when the obstacle does not exist in the obstacle area, performing a return cleaning action.

After re-detected by the sensor system, the movement control method is implemented by further including a step of: when the obstacle exists in the obstacle area, re-planning a cleaning path and performing a detour action.

Specifically, for example, the above-mentioned obstacle area may be re-detected through a distance measuring sensor in the sensor system to determine whether the obstacle still exists in the obstacle area.

When it is determined that the obstacle no longer exists in the obstacle area, the cleaning robot re-plans the cleaning path, and then the cleaning robot performs the return cleaning action to return to the obstacle area for supplementary cleaning according to the cleaning path.

When it is determined that the obstacle still exists in the obstacle area, the cleaning robot re-acquires the three-dimensional information of the obstacle through the sensor system, and detects and identifies the obstacle based on the three-dimensional information of the obstacle to determine the specific type of the obstacle. Furthermore, the cleaning path that matches the obstacle may be re-planned based on the specific type of the obstacle, and then the detour action based on the cleaning path is performed. In this way, the cleaning robot may clean as many areas as possible while avoiding obstacles, and obtain better cleaning results.

In an embodiment, after re-detected by the sensor system, the movement control method is implemented by further including a step of: when the obstacle exists in the obstacle area and the obstacle is a human, broadcasting relevant prompt information by voice.

Specifically, after re-detected by the sensor system, when it is determined that the obstacle still exists in the obstacle area, the three-dimensional information of the obstacle with higher quality that meets the requirements may be effectively acquired through the sensor system.

Then, a pre-trained obstacle detection model may be used to process the above three-dimensional information of the obstacle to acquire corresponding obstacle detection results. The above-mentioned obstacle detection model may be specifically understood as a neural network model which is trained in advance using a large amount of three-dimensional information of sample obstacles and can automatically identify and determine the obstacle type.

According to the above obstacle detection results, when it is determined that the obstacle is a human, relevant prompt information may be broadcast by voice to the human. For example, a voice prompts the human to move out of the way to facilitate cleaning.

After the relevant prompt information is broadcast by voice, the obstacle area is re-detected through the sensor system after a preset time interval (for example, an interval of 1 minute). When the obstacle does not exist in the obstacle area, the return cleaning action is performed.

It can be seen from the above that, in the movement control method of the cleaning robot provided by the embodiments of the present disclosure, during travel of the cleaning robot, the three-dimensional information of the obstacle is acquired through the sensor system. When it is detected that an obstacle moves within the detection range of the sensor system, when the distance between the obstacle and the cleaning robot along the central axis of the cleaning robot is less than the first preset detection threshold, when the maximum value among the vertical distances between the obstacle and the central axis of the cleaning robot is greater than the second preset detection threshold, and when the minimum value among the vertical distances between the obstacle and the central axis of the cleaning robot is less than the second preset detection threshold, it can be automatically determined that the sensor system cannot effectively acquire high-quality three-dimensional information of the obstacle that meets the requirements at present, and it then intelligently performs the action away from the obstacle. This allows the sensor system of the cleaning robot to effectively acquire the three-dimensional information of the obstacle that meets the requirements and achieve accurate identification of the obstacle. Specifically, the type, shape, size and other characteristics of the obstacle are accurately identified based on the above three-dimensional information of the obstacle, and obstacle identification results with higher accuracy and better effect are acquired. Based on the obstacle identification results, the cleaning robot may adopt the most appropriate obstacle avoidance or cleaning strategy.

The present disclosure also provides another movement control method of a cleaning robot, which is applied to the cleaning robot. The cleaning robot is equipped with a sensor system capable of acquiring three-dimensional information of an obstacle. The specific implementation of the movement control method may include a step of:

During travel of the cleaning robot, when an obstacle moves within a detection range of the sensor system, when a distance between the obstacle and the cleaning robot along a central axis of the cleaning robot is greater than or equal to a first preset detection threshold, when a maximum value among vertical distances between the obstacle and the central axis of the cleaning robot is greater than a second preset detection threshold, and when a minimum value among the vertical distances between the obstacle and the central axis of the cleaning robot is less than the second preset detection threshold, performing a steering action; where the central axis of the cleaning robot is parallel to the current traveling direction of the cleaning robot.

During specific implementation, when the distance between the obstacle and the cleaning robot along the central axis of the cleaning robot is greater than or equal to the first preset detection threshold, when the maximum value among the vertical distances between the obstacle and the central axis of the cleaning robot is greater than the second preset detection threshold, and when the minimum value among the vertical distances between the obstacle and the central axis of the cleaning robot is less than the second preset detection threshold, it can be determined a current detection direction of the sensor system is inconsistent with a current direction of the object relative to the cleaning robot, and there is a certain deviation angle therebetween. Moreover, if the cleaning robot continues to travel along the current path, there is a high probability that it will collide with the obstacle.

In view of the above situation, by performing the steering action, the deviation angle between the detection direction of the sensor system and the direction of the obstacle relative to the cleaning robot can be effectively reduced, so that the sensor system can face the obstacle as much as possible, so as to better acquire the three-dimensional information of the obstacle. Alternatively, by performing the steering action, the cleaning robot can avoid the obstacle in front of it and prevent the cleaning robot from colliding with the obstacle.

Specifically, for example, the current detection direction of the sensor system and the current direction of the obstacle relative to the cleaning robot are determined first, and then the direction deviation angle between the sensor system and the obstacle is determined based on the current detection direction of the sensor system and the current direction of the obstacle relative to the cleaning robot. The cleaning robot is then controlled to perform the steering action according to the direction deviation angle to adjust the detection direction of the sensor system so that the sensor system can face the obstacle as much as possible. This allows the sensor system to more effectively acquire the three-dimensional information of the obstacle that meets the requirements. Furthermore, the type, shape, size and other characteristics of the obstacle can be accurately identified based on the above three-dimensional information of the obstacle, and obstacle identification results with higher accuracy and better effect can be obtained. Based on the obstacle identification results, the cleaning robot may adopt the most appropriate obstacle avoidance or cleaning strategy.

In an embodiment, the second preset detection threshold is greater than or equal to 0.45 times a maximum length of the body of the cleaning robot in a direction perpendicular to the central axis of the cleaning robot, and less than or equal to 0.55 times the maximum length of the body of the cleaning robot in the direction perpendicular to the central axis of the cleaning robot.

The present disclosure also provides another movement control method of a cleaning robot, which is applied to the cleaning robot. The cleaning robot is equipped with a sensor system capable of acquiring three-dimensional information of an obstacle. The specific implementation of the movement control method may include a step of:

During travel of the cleaning robot, when there is an obstacle, when a distance between the obstacle and the cleaning robot along a central axis of the cleaning robot is greater than or equal to a first preset detection threshold, when a maximum value among included angles between connection lines constituted by a first reference point of the cleaning robot and second reference points of the obstacle and a current traveling direction of the cleaning robot is greater than a third preset detection threshold, and when a minimum value among the included angles between the connection lines constituted by the first reference point of the cleaning robot and the second reference points of the obstacle and the current traveling direction of the cleaning robot is less than the third preset detection threshold, performing a steering action; where the central axis of the cleaning robot is parallel to the current traveling direction of the cleaning robot, the first reference point is one point closer to the obstacle along the current traveling direction in intersection points of a body boundary of the cleaning robot and the central axis of the cleaning robot, the second reference points are intersection points of an outer peripheral boundary of the obstacle and a reference line of the obstacle, and the reference line is perpendicular to the central axis.

During specific implementation, when the distance between the obstacle and the cleaning robot along the central axis of the cleaning robot is greater than or equal to the first preset detection threshold, when the maximum value among the included angles between the connection lines constituted by the first reference point of the cleaning robot and the second reference points of the obstacle and the current traveling direction of the cleaning robot is greater than the third preset detection threshold, and when the minimum value among the included angles between the connection lines constituted by the first reference point of the cleaning robot and the second reference points of the obstacle and the current traveling direction of the cleaning robot is less than the third preset detection threshold, it can be determined that a current detection direction of the sensor system is inconsistent with a current direction of the object relative to the cleaning robot, and there is a certain deviation angle therebetween. Moreover, if the cleaning robot continues to travel along the current path, there is a high probability that it will collide with the obstacle.

In view of the above situation, by performing the steering action, the deviation angle between the detection direction of the sensor system and the direction of the obstacle relative to the cleaning robot can be effectively reduced, so that the sensor system can face the obstacle as much as possible, so as to better acquire the three-dimensional information of the obstacle. Alternatively, by performing the steering action, the cleaning robot can avoid the obstacle in front of it and prevent the cleaning robot from colliding with the obstacle.

Figure 7:
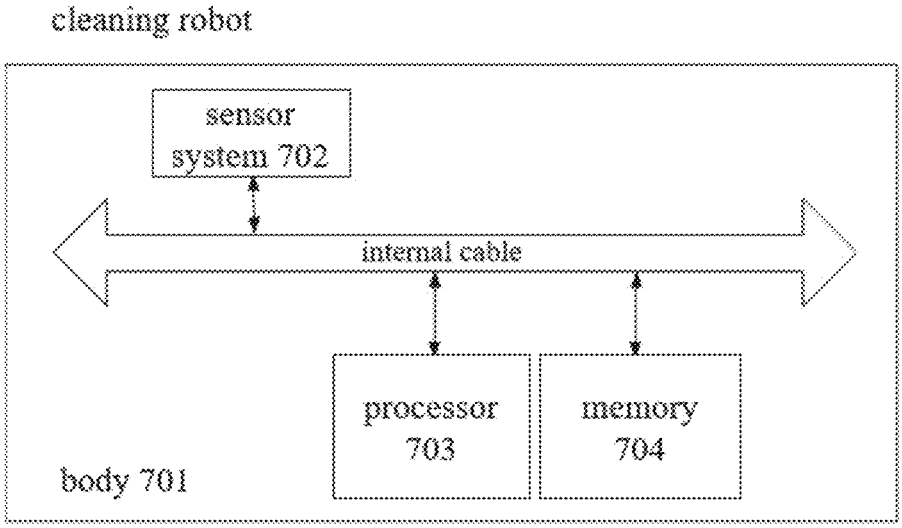
FIG. 7 is a schematic block diagram of a cleaning robot based on one or more embodiments of the present disclosure.

Referring to FIG. 7, embodiments of the present disclosure also provide a cleaning robot. The cleaning robot includes a body 701, a sensor system 702 provided on the body 701 and capable of acquiring three-dimensional information of an obstacle, a processor 703 (or controller), and a memory 704 for storing instructions executable by the processor 703.

During travel of the cleaning robot, the processor 703 is configured to implement relevant steps of the movement control method of the cleaning robot by executing relevant instructions in the memory 704, so that the sensor system 702 can effectively acquire three-dimensional information of the obstacle that meet the requirements.

During specific implementation, when the processor 703 detects through the sensor system 702 that there is an obstacle moving within the detection range of the sensor system, a distance between the obstacle and the cleaning robot along a central axis of the cleaning robot is less than a first preset detection threshold, a maximum value among vertical distances between the obstacle and the central axis of the cleaning robot is greater than a second preset detection threshold, and a minimum value among the vertical distances between the obstacle and the central axis of the cleaning robot is less than the second preset detection threshold, the processor 703 controls the cleaning robot to perform an action away from the obstacle to enable the sensor system to acquire three-dimensional information of the obstacle; where the central axis of the cleaning robot is parallel to the current traveling direction of the cleaning robot.

During specific implementation, when the processor 703 detects through the sensor system 702 that there is an obstacle moving within the detection range of the sensor system 702, a distance between the obstacle and the cleaning robot along a central axis of the cleaning robot is less than a first preset detection threshold, a maximum value among included angles between connection lines constituted by a first reference point of the cleaning robot and second reference points of the obstacle and a current traveling direction of the cleaning robot is greater than a third preset detection threshold, and a minimum value among the included angles between the connection lines constituted by the first reference point of the cleaning robot and the second reference points of the obstacle and the current traveling direction of the cleaning robot is less than the third preset detection threshold, the processor 703 controls the cleaning robot to perform an action away from the obstacle to enable the sensor system to acquire three-dimensional information of the obstacle; where the central axis of the cleaning robot is parallel to the current traveling direction of the cleaning robot, the first reference point is one point closer to the obstacle along the current traveling direction in intersection points of a body boundary of the cleaning robot and the central axis of the cleaning robot, the second reference points are intersection points of an outer peripheral boundary of the obstacle and a reference line of the obstacle, and the reference line is perpendicular to the central axis.

During specific implementation, when the processor 703 detects through the sensor system 702 that there is an obstacle moving within the detection range of the sensor system, and an observation angle of the cleaning robot relative to the obstacle is greater than a fourth preset detection threshold, the processor 703 controls the cleaning robot to perform an action away from the obstacle to enable the sensor system to acquire three-dimensional information of the obstacle.

During specific implementation, when the processor 703 detects through the sensor system 702 that there is an obstacle moving within the detection range of the sensor system, the distance between the obstacle and the cleaning robot along the central axis of the cleaning robot is greater than or equal to the first preset detection threshold, a maximum value among vertical distances between the obstacle and the central axis of the cleaning robot is greater than a second preset detection threshold, and a minimum value among the vertical distance between the obstacle and the central axis of the cleaning robot is less than the second preset detection threshold, the processor 703 controls the cleaning robot to perform a steering action; where the central axis of the cleaning robot is parallel to the current traveling direction of the cleaning robot.

During specific implementation, when the processor 703 detects through the sensor system 702 that there is an obstacle moving within the detection range of the sensor system, and the distance between the obstacle and the cleaning robot along the central axis of the cleaning robot is greater than or equal to the first preset detection threshold, a maximum value among included angles between connection lines constituted by a first reference point of the cleaning robot and second reference points of the obstacle and a current traveling direction of the cleaning robot is greater than a third preset detection threshold, and a minimum value among the included angles between the connection lines constituted by the first reference point of the cleaning robot and the second reference points of the obstacle and the current traveling direction of the cleaning robot is less than the third preset detection threshold, the processor 703 controls the cleaning robot to perform a steering action; where the central axis of the cleaning robot is parallel to the current traveling direction of the cleaning robot, the first reference point is one point closer to the obstacle along the current traveling direction in intersection points of a body boundary of the cleaning robot and the central axis of the cleaning robot, the second reference points are intersection points of an outer peripheral boundary of the obstacle and a reference line of the obstacle, and the reference line is perpendicular to the central axis.

In the embodiments, the processor 703 may be implemented in any appropriate manner. For example, the processor may take a form of a microprocessor/processor and a computer-readable medium, a logic gate, a switch, an application specific integrated circuit (ASIC), a programmable logic controller, or an embedded microcontroller that stores computer-readable program code (such as software or firmware) that can be executed by the microprocessor/processor. The present disclosure does not limit it.

In the embodiments, the memory 704 may include multiple levels. In a digital system, any memory that can store binary data can be a memory. In an integrated circuit, a circuit with storage function that has no physical form is also called memory, such as Random Access Memory (RAM), First Input First Output (FIFO), etc. In a system, a storage device in physical form is also called memory, such as a memory stick, a Trans-flash (TF) card, etc.

Embodiments of the present disclosure also provide a computer-readable storage medium based on the above-mentioned movement control method of a cleaning robot. The computer-readable storage medium stores computer program instructions, and the computer program instructions are executed to implement a step of: during travel of the cleaning robot, when there is an obstacle that moves within a detection range of the sensor system, when a distance between the obstacle and the cleaning robot along a central axis of the cleaning robot is less than a first preset detection threshold, when a maximum value among vertical distances between the obstacle and the central axis of the cleaning robot is greater than a second preset detection threshold, and when a minimum value among the vertical distances between the obstacle and the central axis of the cleaning robot is less than the second preset detection threshold, performing an action away from the obstacle to enable the sensor system to acquire three-dimensional information of the obstacle; where the central axis of the cleaning robot is parallel to the current traveling direction of the cleaning robot.

Embodiments of the present disclosure also provide another computer-readable storage medium based on the above-mentioned movement control method of a cleaning robot. The computer-readable storage medium stores computer program instructions, and the computer program instructions are executed to implement a step of: during travel of the cleaning robot, when there is an obstacle, when a distance between the obstacle and the cleaning robot along a central axis of the cleaning robot is less than a first preset detection threshold, when a maximum value among included angles between connection lines constituted by a first reference point of the cleaning robot and second reference points of the obstacle and a current traveling direction of the cleaning robot is greater than a third preset detection threshold, and when a minimum value among the included angles between the connection lines constituted by the first reference point of the cleaning robot and the second reference points of the obstacle and the current traveling direction of the cleaning robot is less than the third preset detection threshold, performing an action away from the obstacle to enable the sensor system to acquire three-dimensional information of the obstacle; where the central axis of the cleaning robot is parallel to the current traveling direction of the cleaning robot, the first reference point is one point closer to the obstacle along the current traveling direction in intersection points of a body boundary of the cleaning robot and the central axis of the cleaning robot, the second reference points are intersection points of an outer peripheral boundary of the obstacle and a reference line of the obstacle, and the reference line is perpendicular to the central axis.

Embodiments of the present disclosure also provide another computer-readable storage medium based on the above-mentioned movement control method of a cleaning robot. The computer-readable storage medium stores computer program instructions, and the computer program instructions are executed to implement a step of: during travel of the cleaning robot, when there is an obstacle, and when an observation angle of the cleaning robot relative to the obstacle is greater than a fourth preset detection threshold, performing an action away from the obstacle to enable the sensor system to acquire three-dimensional information of the obstacle.

Embodiments of the present disclosure also provide another computer-readable storage medium based on the above-mentioned movement control method of a cleaning robot. The computer-readable storage medium stores computer program instructions, and the computer program instructions are executed to implement a step of: during travel of the cleaning robot, when there is an obstacle moving within the detection range of the sensor system, when the distance between the obstacle and the cleaning robot along the central axis of the cleaning robot is greater than or equal to the first preset detection threshold, when a maximum value among vertical distances between the obstacle and the central axis of the cleaning robot is greater than a second preset detection threshold, and when a minimum value among the vertical distance between the obstacle and the central axis of the cleaning robot is less than the second preset detection threshold, performing a steering action; where the central axis of the cleaning robot is parallel to the current traveling direction of the cleaning robot.

Embodiments of the present disclosure also provide another computer-readable storage medium based on the above-mentioned movement control method of a cleaning robot. The computer-readable storage medium stores computer program instructions, and the computer program instructions are executed to implement a step of: during travel of the cleaning robot, when there is an obstacle moving within the detection range of the sensor system, when the distance between the obstacle and the cleaning robot along the central axis of the cleaning robot is greater than or equal to the first preset detection threshold, when a maximum value among included angles between connection lines constituted by a first reference point of the cleaning robot and second reference points of the obstacle and a current traveling direction of the cleaning robot is greater than a third preset detection threshold, and when a minimum value among the included angles between the connection lines constituted by the first reference point of the cleaning robot and the second reference points of the obstacle and the current traveling direction of the cleaning robot is less than the third preset detection threshold, performing a steering action; where the central axis of the cleaning robot is parallel to the current traveling direction of the cleaning robot, the first reference point is one point closer to the obstacle along the current traveling direction in intersection points of a body boundary of the cleaning robot and the central axis of the cleaning robot, the second reference points are intersection points of an outer peripheral boundary of the obstacle and a reference line of the obstacle, and the reference line is perpendicular to the central axis.

In the embodiments, the above-mentioned storage medium includes but is not limited to a random access memory (RAM), a read-only memory (ROM), a cache, a hard disk drive (HDD), or a memory card. The memory is configured to store the computer program instructions. A network communication unit may be an interface configured in accordance with the standards specified by the communication protocol and used for network connection communication.

In the embodiments, functions and effects specifically implemented by the program instructions stored in the computer-readable storage medium are explained in comparison with other embodiments, and will not be described again here.

Embodiments of the present disclosure also provide a computer program product, which at least includes a computer program, and the computer program is executed by the processor to implement relevant steps of the movement control method of the cleaning robot.

At the software level, embodiments of the present disclosure also provide a mobile control device for a cleaning robot, which may specifically include a control module.

The above-mentioned control module may be specifically configured to control the cleaning robot to perform an action away from an obstacle to enable a sensor system to acquire three-dimensional information of the obstacle during travel of the cleaning robot, on a condition that the obstacle moves within a detection range of the sensor system, and when a distance between the obstacle and the cleaning robot along a central axis of the cleaning robot is less than a first preset detection threshold, a maximum value among vertical distances between the obstacle and the central axis of the cleaning robot is greater than a second preset detection threshold, and a minimum value among the vertical distances between the obstacle and the central axis of the cleaning robot is less than the second preset detection threshold. The central axis of the cleaning robot is parallel to the current traveling direction of the cleaning robot.

It should be noted that the units, devices, or modules explained in the above embodiments may be implemented by computer chips or entities, or by products with certain functions. For the convenience of description, when describing the above device, the functions are divided into various modules and described separately. Of course, when implementing the present disclosure, the functions of each module may be implemented in the same or multiple software and/or hardware, or a module that implements the same function may be implemented by a combination of multiple sub-modules or sub-units. The device embodiments described above are only illustrative. For example, the division of the units is only a logical function division. In actual implementation, there may be other division methods. For example, multiple units or components may be combined or integrated to another system, or some features may be ignored, or not implemented. In another aspect, the coupling or direct coupling or communication connection between each other shown or discussed may be through some interfaces, and the indirect coupling or communication connection of the devices or units may be in electrical, mechanical, or other forms.

It can be seen from the above that the mobile control device of the cleaning robot provided by the embodiments of the present disclosure can enable the sensor system of the cleaning robot to effectively acquire the three-dimensional information of the obstacle and achieve accurate identification of the obstacle. Furthermore, the type, shape, size and other characteristics of the obstacle can be accurately identified based on the above three-dimensional information of the obstacle, and obstacle identification results with higher accuracy and better effect can be obtained. Based on the obstacle identification results, the cleaning robot may adopt the most appropriate obstacle avoidance or cleaning strategy.

Although the present disclosure provides method operation steps as described in the embodiments or flow charts, more or fewer operation steps may be included based on conventional or non-inventive means. The sequence of steps listed in the embodiment is only one way of executing the sequence of many steps, and does not represent the only execution sequence. When the actual device or client product is executed, it can be executed sequentially or in parallel (for example, a parallel processor or a multi-thread processing environment, or even a distributed data processing environment) according to the methods shown in the embodiments or figures. The terms "comprise", "include" or any other variation thereof are intended to cover a non-exclusive inclusion such that a process, method, product, or apparatus including a list of elements includes not only those elements but also others not expressly listed elements, or also elements inherent to the process, method, product or apparatus. Without further limitation, it does not exclude the presence of additional identical or equivalent elements in a process, method, product or apparatus including the stated elements. The terms such as first and second are used to indicate names and do not indicate any specific order.

Those skilled in the art also know that, in addition to implementing functions of the controller in the form of pure computer-readable program code, it is possible to logically program the method steps so that the controller may achieve the same functions in the form of logic gates, switches, application-specific integrated circuits, programmable logic controllers, or embedded microcontroller. Therefore, the controller may be considered as a hardware component, and elements included therein for implementing various functions may also be considered as structures within the hardware component. Or even, the means for implementing various functions may be considered as structures within hardware components as well as software modules implementing the methods.

The present disclosure may be described in the general context of computer-executable instructions, such as program modules, being executed by a computer. Generally, program modules include routines, programs, objects, components, data structures, classes, etc. that perform specific tasks or implement specific abstract data types. The present disclosure may also be practiced in distributed computing environments where tasks are performed by remote processing devices connected through communications networks. In the distributed computing environment, program modules may be located in both local and remote computer-readable storage media including the storage device.

From the description of the above embodiments, those skilled in the art can clearly understand that the present disclosure can be implemented by means of software plus a necessary general hardware platform. Based on this understanding, the technical solutions in the present disclosure can essentially be embodied in the form of a software product. The computer software product can be stored in a storage medium, such as ROM/RAM, magnetic disk, optical disk, etc., and includes a number of instructions to make a computer device (which may be a personal computer, a mobile terminal, a server, a network device, etc.) executes the methods described in various embodiments or some parts of the embodiments of the present disclosure.

Each embodiment in the present disclosure is described in a progressive manner. The same or similar parts between the various embodiments can be referred to each other. Each embodiment focuses on its differences from other embodiments. These instructions may be used in a variety of general or special purpose computer system environments or configurations. For example, personal computers, server computers, handheld or portable devices, tablet devices, multiprocessor systems, microprocessor-based systems, set-top boxes, programmable electronic devices, network PCs, minicomputers, mainframe computers, a distributed computing environment including any of the above systems or devices, etc.

Some embodiments of the present disclosure have been described in detail above. Many modifications or equivalent substitutions with respect to the embodiments may occur to those of ordinary skill in the art based on the present disclosure. Thus, these modifications or equivalent substitutions shall fall within the scope of the present disclosure.

What is claimed is:

1. A movement control method of a cleaning robot, wherein the movement control method is applied to the cleaning robot, the cleaning robot is provided with a sensor system capable of acquiring three-dimensional information of an obstacle, and the movement control method comprises:

during travel of the cleaning robot, when the obstacle moves within a detection range of the sensor system, when a distance between the obstacle and the cleaning robot along a central axis of the cleaning robot is less than a first preset detection threshold, when a maximum value among included angles between connection lines constituted by a first reference point of the cleaning robot and second reference points of the obstacle and a current traveling direction of the cleaning robot is greater than a third preset detection threshold, and when a minimum value among the included angles between the connection lines constituted by the first reference point of the cleaning robot and the second reference points of the obstacle and the current traveling direction of the cleaning robot is less than the third preset detection threshold, performing an action away from the obstacle to enable the sensor system to acquire three-dimensional information of the obstacle, wherein the central axis of the cleaning robot is parallel to the current traveling direction of the cleaning robot, the first reference point is one point closer to the obstacle along the current traveling direction in intersection points of a body boundary of the cleaning robot and the central axis of the cleaning robot, the second reference points are intersection points of an outer peripheral boundary of the obstacle and a reference line of the obstacle, and the reference line is perpendicular to the central axis.

2. The movement control method according to claim 1, wherein the movement control method further comprises:

when the distance between the obstacle and the cleaning robot along the central axis of the cleaning robot is less than the first preset detection threshold, and when the minimum value among the included angles between the connection lines constituted by the first reference point of the cleaning robot and the second reference points of the obstacle and the current traveling direction of the cleaning robot is greater than or equal to the third preset detection threshold, not performing the action away from the obstacle and continuing to travel along a current traveling path.

3. The movement control method according to claim 1, wherein the sensor system comprises one or more of a monocular vision sensor, a binocular vision sensor, a line laser sensor, a surface laser sensor, a laser direct structuring (LDS) sensor, a direct time of flight (Dtof) sensor, and an indirect time of flight (Itof) sensor; and the first preset detection threshold is a minimum value among effective detection distances of sensors in the sensor system.

4. The movement control method according to claim 3, wherein the cleaning robot performs the action away from the obstacle until it moves to a first position, and a distance between the first position and the obstacle is less than a maximum value among the effective detection distances of the sensors in the sensor system.

5. The movement control method according to claim 1, wherein after performing the action away from the obstacle, the movement control method further comprises:

performing a steering action to adjust a detection direction of the sensor system so that the sensor system acquires the three-dimensional information of the obstacle.

6. The movement control method according to claim 1, wherein after performing the action away from the obstacle, the movement control method further comprises:

executing a waiting action;

during a waiting period, re-detecting an obstacle area through the sensor system; and when the obstacle does not exist in the obstacle area, performing a return cleaning action.

7. The movement control method according to claim 6, wherein after re-detecting the obstacle area through the sensor system, the movement control method further comprises:

when the obstacle exists in the obstacle area, re-planning a cleaning path and performing a detour action.

8. The movement control method according to claim 6, wherein after re-detecting the obstacle area through the sensor system, the movement control method further comprises:

when the obstacle exists in the obstacle area and the obstacle is a human, broadcasting relevant prompt information by voice.

9. A cleaning robot, wherein the cleaning robot comprises a body, a sensor system provided on the body and capable of acquiring three-dimensional information of an obstacle, a processor, and a memory for storing instructions executable by the processor;

during travel of the cleaning robot, when the processor executes the instructions, steps of the movement control method according to claim 1 are implemented to enable the sensor system to acquire the three-dimensional information of the obstacle.

10. A non-transitory computer readable storage medium, wherein the non-transitory computer readable storage medium comprises a stored program, and the program is executed to perform the movement control method according to claim 1.

11. A movement control method of a cleaning robot, wherein the movement control method is applied to the cleaning robot, the cleaning robot is provided with a sensor system capable of acquiring three-dimensional information of an obstacle, and the movement control method comprises:

during travel of the cleaning robot, when the obstacle moves within a detection range of the sensor system, when a distance between the obstacle and the cleaning robot along a central axis of the cleaning robot is greater than or equal to a first preset detection threshold, when a maximum value among included angles between connection lines constituted by a first reference point of the cleaning robot and second reference points of the obstacle and a current traveling direction of the cleaning robot is greater than a third preset detection threshold, and when a minimum value among the included angles between the connection lines constituted by the first reference point of the cleaning robot and the second reference points of the obstacle and the current traveling direction of the cleaning robot is less than the third preset detection threshold, performing a steering action, wherein the central axis of the cleaning robot is parallel to the current traveling direction of the cleaning robot, the first reference point is one point closer to the obstacle along the current traveling direction in intersection points of a body boundary of the cleaning robot and the central axis of the cleaning robot, the second reference points are intersection points of an outer peripheral boundary of the obstacle and a reference line of the obstacle, and the reference line is perpendicular to the central axis.

* * * * *